US005172600A

United States Patent [19]

Cissell et al.

[11] Patent Number: 5,172,600

[45] Date of Patent: Dec. 22, 1992

[54] LINEAR WEIGHT ACTUATOR

[75] Inventors: Thomas J. Cissell; David C. Doerschuk, both of Columbus; Karsten G. Koester, Plain City; Gordon K. Reed, Bexley, all of Ohio

[73] Assignee: ABB Process Automation Inc., Columbus, Ohio

[21] Appl. No.: 642,988

[22] Filed: Jan. 18, 1991

[51] Int. Cl.[5] ..... F16H 29/20

[52] U.S. Cl. ..... 74/89.15; 74/424.8 R

[58] Field of Search ..... 74/89.15, 424.8 R; 408/158, 181; 279/1 H, 9 A, 76, 78, 112

[56] References Cited

U.S. PATENT DOCUMENTS

| | | | |
|---|---|---|---|
| 1,655,734 | 1/1928 | McWilliams | 279/112 |
| 2,179,573 | 11/1939 | Criddle | 408/158 |
| 2,434,104 | 1/1948 | Esseling | 74/424.8 R X |
| 2,564,460 | 8/1951 | Blanco | 408/181 X |
| 3,159,081 | 12/1964 | Erikson | 279/76 X |
| 3,479,890 | 11/1969 | Howell | 74/89.15 |
| 3,618,962 | 11/1971 | Cox et al. | 279/76 X |
| 4,186,615 | 2/1980 | Adams | 74/424.8 R X |
| 4,290,344 | 9/1981 | Adams | 74/89.15 X |
| 4,392,390 | 7/1983 | Johnson | 74/89.15 |
| 4,649,764 | 3/1987 | Meade | 74/424.8 R X |
| 4,719,816 | 1/1988 | Carlnäs | 74/89.15 X |
| 5,016,335 | 5/1991 | Becker et al. | 74/89.15 X |

FOREIGN PATENT DOCUMENTS

| | | | |
|---|---|---|---|
| 2355595 | 5/1975 | Fed. Rep. of Germany | 74/424.8 R |
| 2-186157 | 7/1990 | Japan | 74/89.15 |

*Primary Examiner*—Allan D. Herrmann
*Assistant Examiner*—Julie Krolikowski
*Attorney, Agent, or Firm*—Paul J. Lerner

[57] ABSTRACT

A linear weight actuator includes a clamp assembly adjustably connecting the power screw to the output spindle. The assembly includes an integrally formed key, riding in a slot formed in the actuator housing, which obviates the need for a separate key element. A mounting plate is adjustably clamped to the actuator housing, by a threaded mounting nut, such that the plate may be conveniently rotated relative to the housing. A linear bearing disposed in the mounting nut provides lateral support for the output spindle at a point spaced from the clamp assembly. A clamping ring encircles a thinned segment of the power nut and urges it against the power screw to prevent backlash.

2 Claims, 5 Drawing Sheets

LINEAR WEIGHT ACTUATOR

BACKGROUND AND SUMMARY OF THE INVENTION

The present invention pertains to actuators and, more particularly, to an actuator especially suited to drive a member such as a paper machine headbox slice opening control spindle.

As illustrated in FIG. 1, a typical paper machine headbox 1 distributes pulp slurry or stock through a long horizontal slit opening 2 onto a traveling perforated web or "wire" 3. Transverse the direction of wire travel, paper density or "weight" can be changed by opening or closing a long stainless steel bar or "slice lip" 4 which comprises the top of the slit opening and, therefore, determines its height. Attached to the slice lip 4 are spindles or "slice rods" 5 which are typically spaced about 3 to 6 inches apart. By exerting a linear force through these spindles, "weight actuators" 6 can elastically deform the slice lip 4 into a shape which produces a slit opening that yields a paper sheet having a preselected weight that is uniform across the sheet.

Historically, the weight actuators driving the spindles were manually controlled. In recent years, however, automatic weight actuators have become available which operate in response to signals generated by weight, moisture and thickness sensors to precisely control distribution of pulp stock onto the wire.

To be effective, an automatic weight actuator must deliver a force ranging from 500 to 4,000 pounds. This force must be delivered in quick, precise, very small steps. At the same time, the actuator must be very small so that it can fit into and onto a multitude of headbox styles which have many and varying nearby encumbrances. Also, because downtime on a paper machine is very expensive, it must be very easy to install and service.

Many existing weight actuators utilize a pneumatic or electric motor driving through a gear reduction to a keyed power screw which, in turn, is mechanically connected to the slice rod.

Due to the normal machining tolerances of the headbox, actuator and slice lip elements, the slice rod often does not line up exactly with the centerline of the actuator drive train. Such misaligned connection imparts a side load on the actuator which can impair and reduce its force producing capability.

Misalignment can also result from a non-level mounting surface for the actuator, incorrectly located actuator mounting holes, a connector that does not attach the actuator and slice concentrically and in proper alignment, or a slice lip connection that does not properly align the slice rod with the actuator. These conditions can require that considerable installation time be devoted to shimming and adjusting the actuator mounting location to produce the best possible alignment.

Existing actuators utilize linear bearings on the output shaft to minimize the transfer of side loads to the actuator mechanism. However, the short length and travel of the actuators requires that these bearings be short and closely spaced, whereby their effectiveness is limited.

Existing actuators utilize a ball screw or power screw to the convert rotary motion of the motor into linear output motion. Such actuators require some type of torque restraint on the output screw or nut to prevent it from turning. Often, this is accomplished by a key, on the output screw or nut riding in a longitudinal slot formed in the actuator housing. To minimize friction and avoid binding, both the key and the slot must have precisely machined surfaces that are properly aligned. This adds complexity and, hence, cost to the actuator, as well as increasing its size.

Below the actuator output shaft, a mechanical connection must be provided between the shaft and the slice rod. Ideally, this connection is made with the actuator at the midpoint of its travel range and the slice lip level. As previously noted, various factors combine to render the precise geometry of each installation unique. To allow for these variations, a turnbuckle or smoothbore clamp is commonly employed as the connector. However, both of these types of connectors must be precisely machined and aligned to minimize side loads and both increase the cost and size of the actuator.

During installation of weight actuators, the orientation and position of the actuator itself is determined by the hole pattern of its mounting plate, as are the positions of connectors for associated electric power cables or compressed air lines. When installing actuators to some headboxes, special adaptor plates are required to position the actuator so as to clear local obstructions. Thus, substantial planning and custom design may be required to effect some installations.

Finally, to achieve the necessary precision, it is desirable to minimize or, if possible, eliminate any power screw backlash. Feedback control systems that measure actuator output position electronically compensate for small amounts of internal backlash but, nevertheless, existing actuators commonly utilize antibacklash components to compensate for the lack of precision machining. These components may comprise two ball nuts or power screws (instead of one) which are adjusted away from each other until the backlash is taken up and then either locked in place or preloaded by a spring. This also adds complexity and cost to the actuator, as well as increasing its length.

It is, therefore, a primary object of the present invention to provide a linear weight actuator which overcomes the aforesaid limitations of the prior art.

This is accomplished, in general, by an actuator wherein a clamp assembly adjustably connects the power screw to the output spindle. The assembly includes an integrally formed key, riding in a slot formed in the actuator housing, which obviates the need for a separate key element.

The actuator further includes a mounting plate adjustably clamped to the actuator housing, by a threaded mounting nut, such that the plate may be conveniently rotated relative to the housing. A linear bearing disposed in the mounting nut provides lateral support for the output spindle at a point spaced from the clamp assembly.

The actuator still further includes a clamping ring encircling a thinned segment of the power nut and urging it against the power screw to prevent backlash.

DETAILED DESCRIPTION OF THE PREFERRED EMBODIMENT

Figure 1:
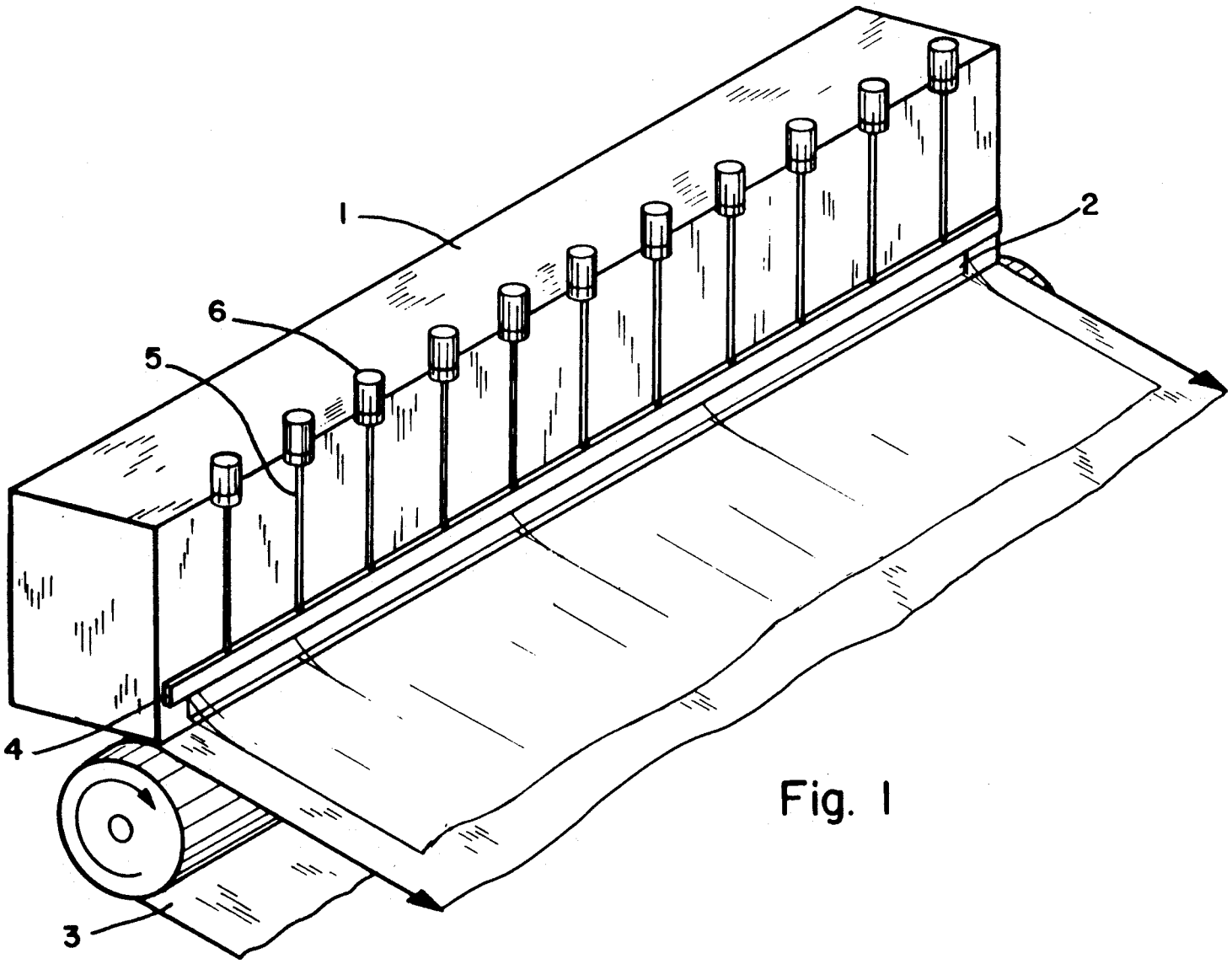
FIG. 1 is a perspective view of the headbox portion of a paper machine.
Figure 2:
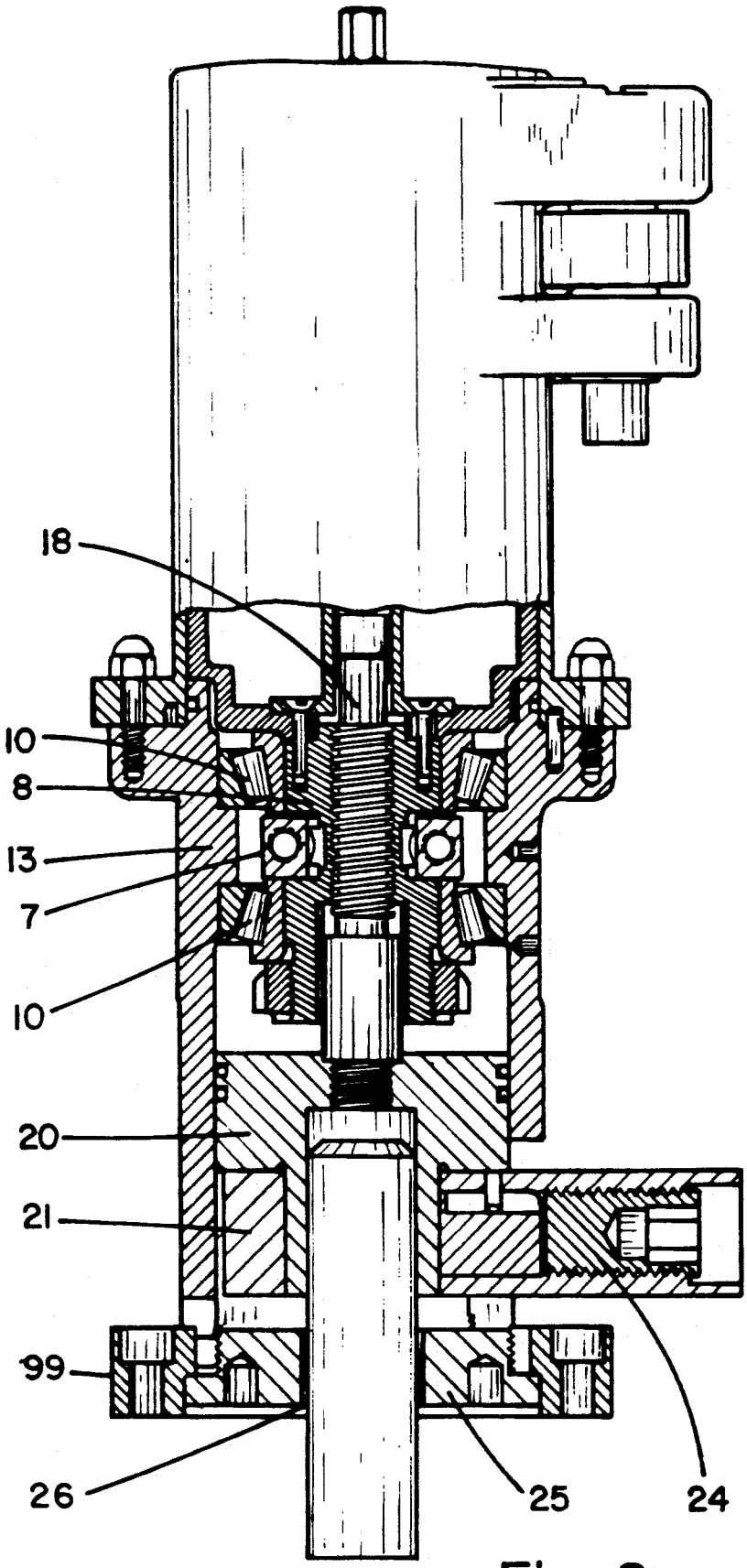
FIG. 2 is a cross-sectional view of a weight actuator arranged in accord with the present invention.
Figure 3:
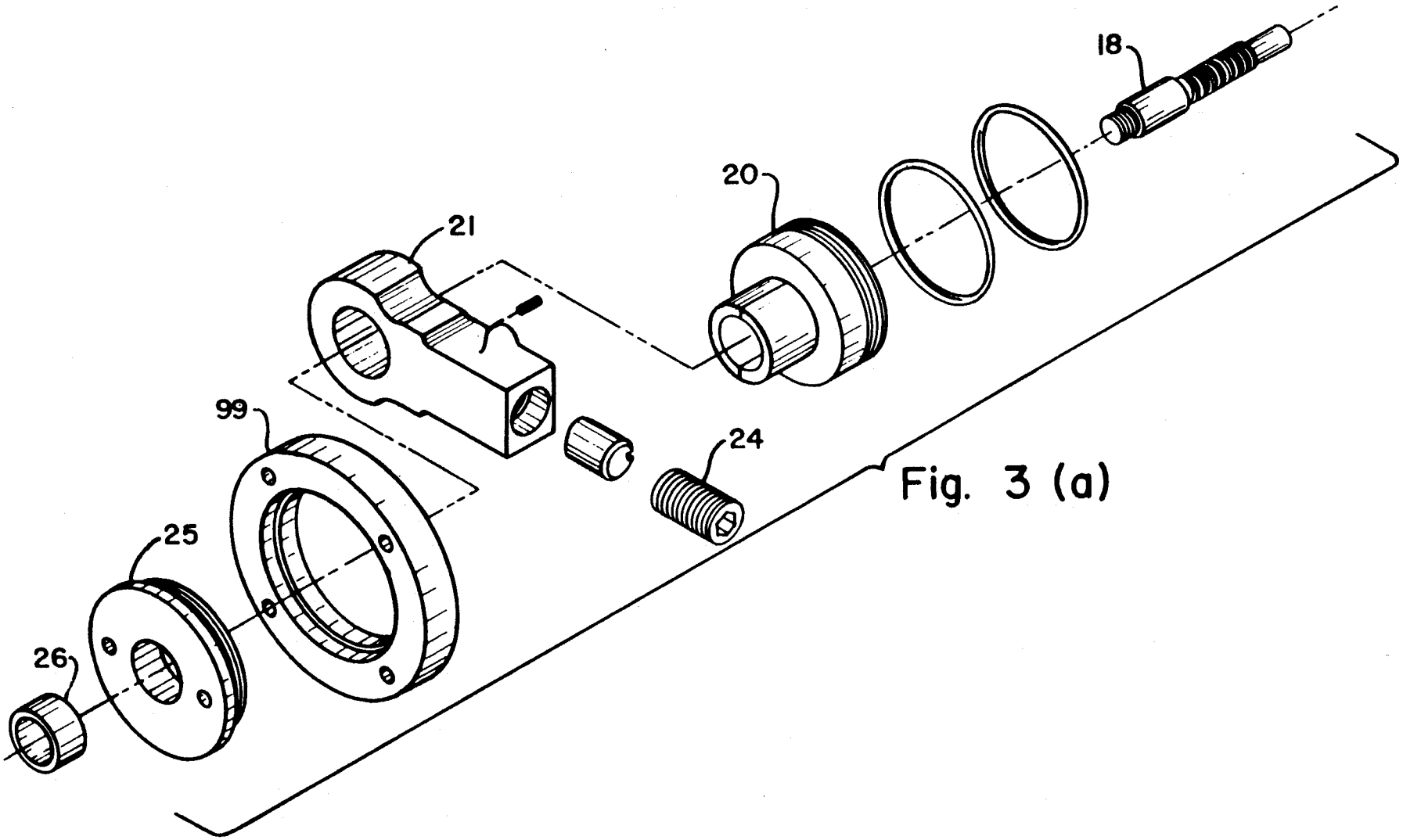
FIGS. 3*a*–3*c* together comprise an exploded view of the weight actuator of FIG. 2.
Figure 3:
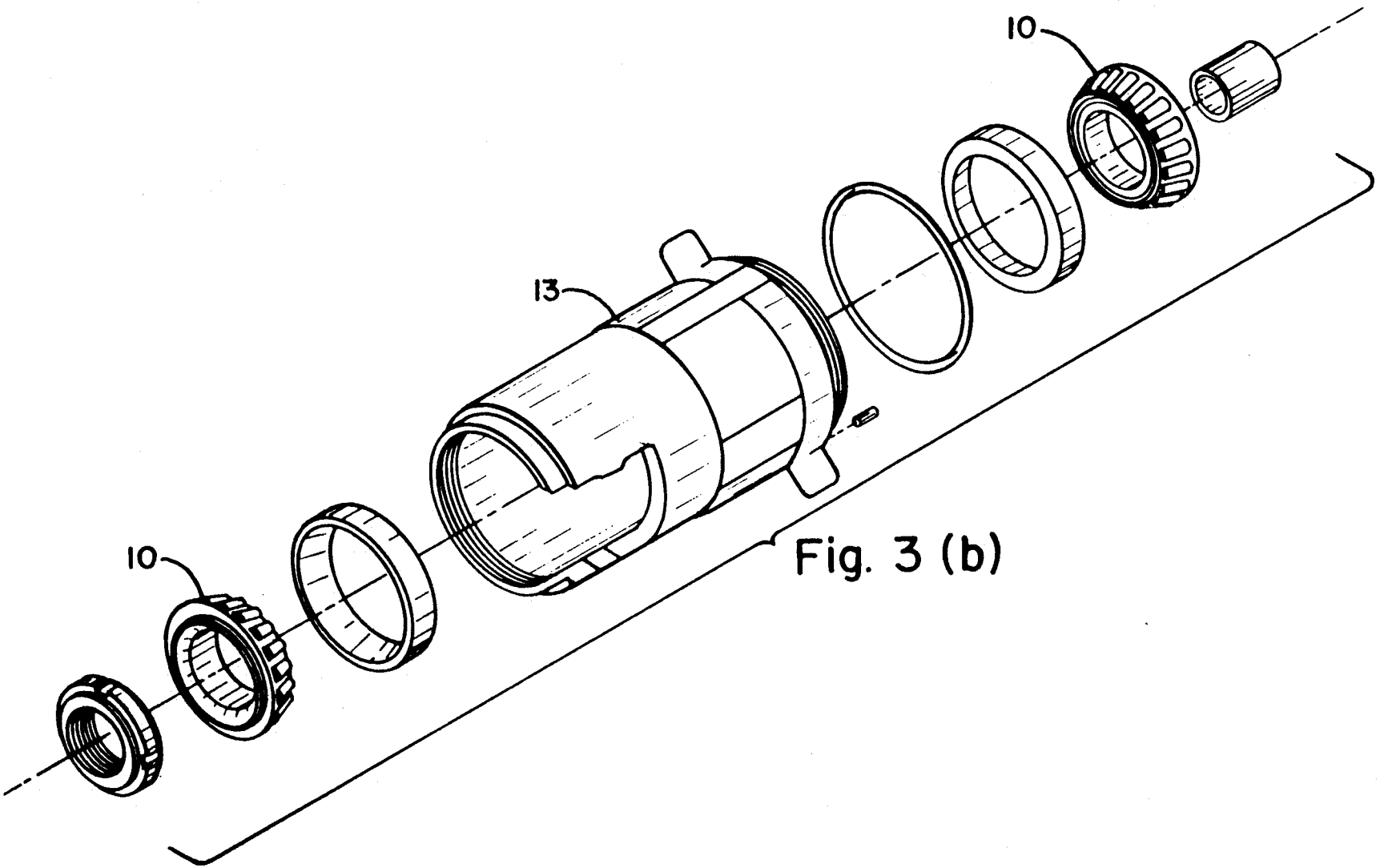
Figure 3:
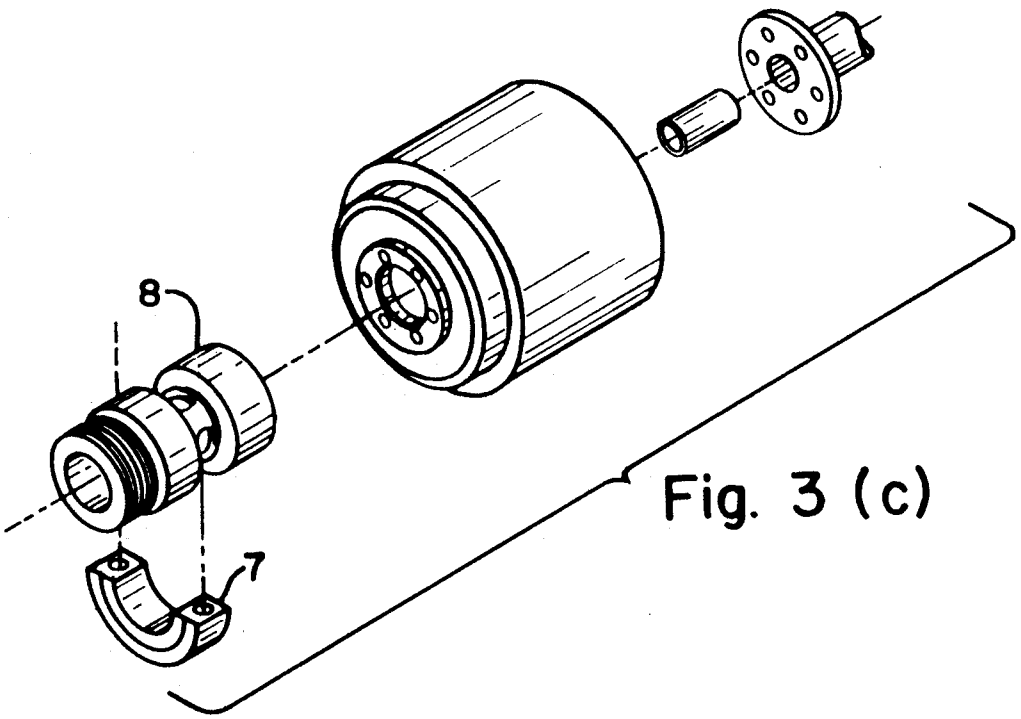

Turning now to the drawing, there is shown a linear weight actuator 11 comprising a motor 3, which may be one of a variety of electric or pneumatic motors of suitable size and torque, driving an internally threaded power nut 8 which is supported in a housing 13 by a spaced pair of anti-friction bearings 10. Power nut 8, which is restrained from axial movement, drives an externally threaded power screw 18, which is connected to the output spindle or slice rod 5 by a collet 20 and a clamp assembly 21.

Collet 20 is threadedly attached to power screw 18 and is adapted for sliding movement in housing 13. Collet 20 includes a projecting, reduced-diameter sleeve 20*a* in which output spindle 5 is adjustably received.

Clamp assembly 21 encircles sleeve 20*a* and includes an integral key portion 21*a* which projects through and is adapted to ride in a slot 13*a* in housing 13. By tightening a setscrew 24, threadedly received in key portion 21*a*, clamp assembly 21 clamps sleeve 20*a* fixedly against output spindle 5. It will be appreciated that output spindle 5 may be freely displaced to a desired longitudinal position, relative to power screw 18, and then locked into position by means of setscrew 24. It will be further appreciated that key portion 21*a* of clamp assembly 21 serves to prevent rotation of power screw 18, whereby rotation of motor 3 is translated into longitudinal displacement of output spindle 5.

A circular mounting plate 99 is adjustably clamped to housing 13 by a threaded mounting nut 25. Mounting plate 99, which is provided with a suitable number of bolt-receiving holes 99*a*, allows attachment of actuator 11 to a desired surface, such as a paper machine headbox 1. It will be appreciated that mounting plate 99 may be freely rotated to a desired orientation, relative to housing 13, and then locked into position by means of mounting nut 25. Output spindle 5 passes through the center of mounting nut 25, where it is laterally supported by linear bearing 26, thereby eliminating any side loads at clamp assembly 21.

Between bearings 10, power nut 8 is provided with cutouts 18*a* that reduce the material thickness of the nut and provide an area for a clamping ring 7. By tightening clamping ring 7, the thinned walls of the nut are deformed slightly and urged against power screw 18, thereby eliminating any backlash between the screw threads.

It is, thus, seen that the present actuator eliminates backlash and provides increased ease and flexibility of mounting in a compact, reduced-cost structure.

We claim:

1. An actuator comprising:

a housing;

a motor fixed in said housing;

a threaded power nut rotatably driven by said motor, said power nut being longitudinally fixed relative to said housing;

a power screw threadedly carried in said power nut;

an output spindle;

clamp means for adjustably connecting said power screw to said output spindle, said clamp means including means for preventing rotation of said power screw relative to said housing;

support means for providing lateral support to said output spindle, said support means engaging said output spindle at a point spaced from said clamp means;

rotatably adjustable mounting means for affixing said actuator to a desired surface, said mounting means including a mounting plate adapted to be affixed to the desired surface and locking means for fixedly clamping said mounting plate to said housing in a desired rotational orientation; said support means comprising a threaded mounting nut.

2. The actuator of claim 1, wherein said support means comprises a bearing disposed in said mounting nut.

* * * * *